US010006681B2

(12) United States Patent
Lifson et al.

(10) Patent No.: US 10,006,681 B2
(45) **Date of Patent: *Jun. 26, 2018**

(54) PULSE WIDTH MODULATION WITH DISCHARGE TO SUCTION BYPASS

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 2589 days.

This patent is subject to a terminal disclaimer.

(21) Appl. No.: 12/447,728

(22) PCT Filed: Dec. 26, 2006

(86) PCT No.: PCT/US2006/049196

§ 371 (c)(1),
(2), (4) Date: Apr. 29, 2009

(87) PCT Pub. No.: WO2008/079122

PCT Pub. Date: Jul. 3, 2008

(65) Prior Publication Data

US 2010/0043468 A1 Feb. 25, 2010

(51) Int. Cl.
*F25B 49/02* (2006.01)
*F25B 41/04* (2006.01)

(52) U.S. Cl.
CPC .... *F25B 41/043* (2013.01); *F25B 2600/0261* (2013.01); *F25B 2600/2521* (2013.01)

(58) Field of Classification Search
CPC ..... F25B 2600/0261
USPC ..... 62/196.3, 228.5, 217, 196.1, 196.2, 225; 417/310
See application file for complete search history.

(56) References Cited

U.S. PATENT DOCUMENTS 4,156,578 A * 5/1979 Agar et al. ..... 415/1
4,180,986 A 1/1980 Shaw
5,167,491 A * 12/1992 Keller et al. ..... 417/28
6,047,556 A 4/2000 Lifson
(Continued)

FOREIGN PATENT DOCUMENTS

WO WO 2005088212 A1 * 9/2005 ..... F25B 41/04

OTHER PUBLICATIONS

Search Report and Written Opinion dated Dec. 11, 2007 for PCT/US2006/49196.

(Continued)

*Primary Examiner* — Christopher R Zerphey
(74) *Attorney, Agent, or Firm* — Carlson, Gaskey & Olds, P.C.

(57) ABSTRACT

A pulse width modulation control is provided for a suction valve located on a suction line. When the flow rate through a refrigerant system needs to be reduced, the suction valve is rapidly cycled from an open position to a closed position. A bypass line connecting compressor discharge to compressor suction with a bypass valve and a discharge valve positioned on the discharge side of the compressor are also provided. When the control closes the suction valve, it also closes the discharge valve to prevent the refrigerant to backflow into the bypass line, and, at the same time, the control opens the bypass valve. Opening of the bypass valve reduces discharge pressure, leading to reduction in compressor power consumption and subsequent operating efficiency gain.

13 Claims, 1 Drawing Sheet

(56) References Cited

U.S. PATENT DOCUMENTS

| | | | |
|---|---|---|---|
| 6,213,731 | B1 | 4/2001 | Deopker et al. |
| 6,449,972 | B2 | 9/2002 | Pham et al. |
| 6,931,867 | B2 | 8/2005 | Healy et al. |

OTHER PUBLICATIONS

Notification of Transmittal of International Preliminary Report on Patentability dated Jul. 24, 2009 for PCT/US2006/49196.
Notification of Transmittal of International Preliminary Report on Patentability dated Aug. 25, 2009 for PCT/US2006/49196.

* cited by examiner

PULSE WIDTH MODULATION WITH DISCHARGE TO SUCTION BYPASS

BACKGROUND OF THE INVENTION

This application relates to a control for a refrigerant system wherein pulse width modulation technique is utilized to improve refrigerant system control and wherein a discharge bypass is operated in conjunction with the pulse width modulation to reduce compressor power consumption.

Refrigerant systems are utilized in many applications to condition a climate controlled environment. In particular, air conditioners and heat pumps are employed to cool and/or heat air entering the climate controlled environment. The cooling or heating load in the environment may vary with ambient conditions, occupancy level, and changes in sensible and latent load demands, and as the temperature and/or humidity set points are adjusted by an occupant of the environment.

Various features are known for providing adjustments in refrigerant system capacity. One approach which has been utilized in the prior art for reducing the capacity of a refrigerant system is the use of pulse width modulation technique to control a fast acting solenoid valve on a compressor suction line. By rapidly cycling this valve utilizing pulse width modulation techniques, additional and accurate capacity control is provided.

The goal of the pulse width modulation control is to efficiently compress the refrigerant at reduced mass flow rates. This is done when the thermal load demand on the refrigerant system is lower than would be provided with a compressor that is fully loaded.

However, this technique does not always achieve the goal of desired efficiency improvement, because even though the suction pressure is reduced substantially when the suction valve is closed (or almost closed), the discharge pressure still remains high causing a compressor power consumption to be higher than desired. Moreover, the compressed refrigerant on the discharge side can backflow into the compression chambers, further increasing compressor power consumption due to this backflow refrigerant re-compression. This problem is particularly acute in compressors that are not equipped with a dynamic discharge valve (as is often the case for compressors used in standard air conditioning applications). The absence of the dynamic discharge valve causes the compressed refrigerant at the discharge pressure to flow back into the compressor compression pockets, promoting increased power consumption. However, the problem also exists in compressors with a dynamic discharge valve, where the refrigerant still needs to be compressed to the discharge pressure. Refrigeration type compressors would normally be an example of compressors used with a dynamic discharge valve.

SUMMARY OF THE INVENTION

In the disclosed embodiment of this invention, a compressor is associated with a refrigerant system. The refrigerant system has a valve capable of rapid cycling. The valve is installed on a suction line, and a pulse width modulation control is provided for that suction valve. The pulse width modulation control is operable to rapidly cycle the valve from an open position to a closed position to change the capacity of the refrigerant system by controlling the amount of refrigerant delivered to the compressor.

A bypass line is provided to connect the compressor discharge side to the suction side; this bypass line also includes a bypass valve. When the suction valve is moved to a closed position by the pulse width modulation control, the bypass valve is opened. In this manner, the compressed refrigerant is returned to the suction line of the compressor. In a disclosed embodiment, the bypass line returns the refrigerant to a location downstream of the suction valve. Since the compressor discharge is now directly connected to the suction line, the refrigerant is not compressed to as high a pressure, and compressor power consumption is significantly reduced.

Although, for illustrative purposes, this invention is described in relation to refrigerant systems incorporating scroll compressors, it is applicable to other compressor types as well.

These and other features of the present invention can be best understood from the following specification and drawings, the following of which is a brief description.

DETAILED DESCRIPTION OF THE PREFERRED EMBODIMENT

Figure 1:
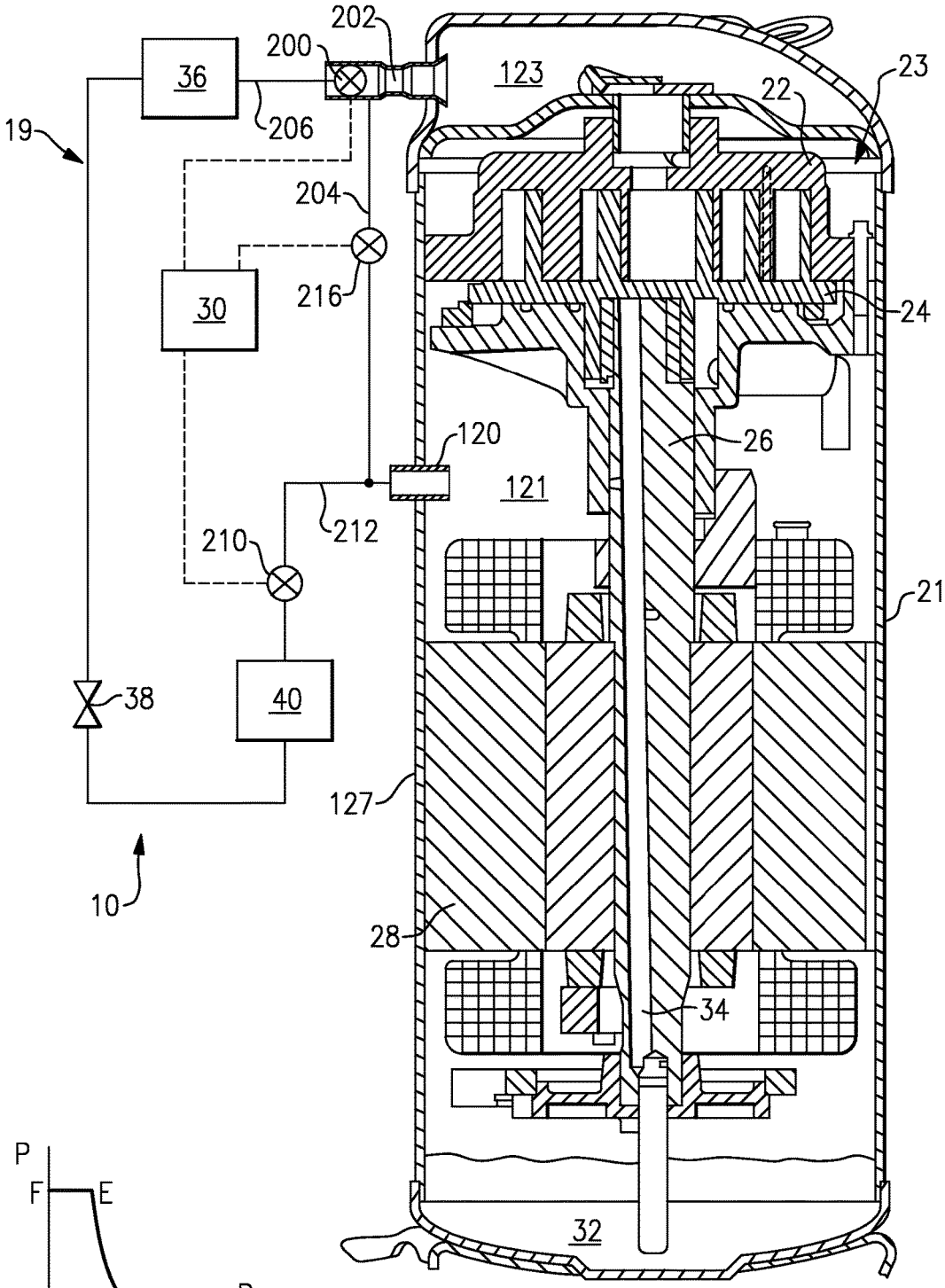
FIG. 1 is a schematic view of a refrigerant system incorporating the present invention.

A refrigerant system 19 is illustrated in FIG. 1 having a scroll compressor 21 incorporating a compressor pump unit 23 having a non-orbiting scroll member 22 and an orbiting scroll member 24. As is known, a shaft 26 is driven by an electric motor 28 to cause the orbiting scroll member 24 to orbit. An oil sump 32 and an oil passage 34 in the shaft 26 supply oil to various moving elements in the compressor 21, as known.

A condenser 36 is positioned downstream of the compressor 21, an expansion device 38 is located downstream of the condenser 36, and an evaporator 40 is positioned downstream of the expansion device 38, as known. As is also known, the compressor 21 is driven by the electric motor 28 to compress a refrigerant and to drive it throughout the refrigerant system 19.

The control 30 may be a microprocessor or other type control that is capable of providing pulse width modulation control to a suction modulation valve 210 positioned on a suction line 212. It should be understood that the control 30 includes a program that accepts inputs from various locations within the refrigerant system, and determines when the pulse width modulation of the suction modulation valve 210 needs to be initiated. Controls capable of performing this invention with such suction modulation valves are known in the art. The valve itself may be a solenoid type valve, again as known.

Now, when the control 30 determines that it would be desirable to reduce capacity of the refrigerant system 19, the suction modulation valve 210 is rapidly cycled from an open position to a closed position (with a cycle rate typically in the 3 to 36 second range) using a pulse width modulation control. For the pulse width modulation cycle, a closed position for the suction modulation valve 210 does not have to be a fully closed position and an open position for the suction modulation valve 210 does not have to be a fully open position.

As is known, the compressor housing shell is sealed such that, when compressor is running, there is a suction pressure in a chamber 121, and there is a discharge pressure in a chamber 123, after the refrigerant has been compressed by the orbiting movements of one of the scroll members 22 and 24 in relation to the other.

As shown, a discharge valve 200 is positioned in a discharge tube 202 (the valve can also be positioned in the discharge line 206, which connects the discharge tube 202 to the condenser 36). The discharge valve 200 may be a solenoid type valve, or may be a mechanical check valve. In the illustrated embodiment, the discharge valve 200 is a solenoid valve, controlled by the control 30. Notably, when the compressor does not run in the pulse width modulation mode, this valve is normally open, such that refrigerant can flow through the discharge tube 202 and to the condenser 36 relatively unimpeded. A bypass line 204 selectively bypasses the refrigerant from the discharge tube 202 (or the discharge line 206, or the discharge pressure chamber 123) back to the suction chamber 121. A bypass valve 216 is positioned on the bypass line 204. The bypass valve 216 typically needs to be open within the time interval of 0 to 0.2 seconds of (before or after) the closing of the pulse width modulation valve 210. Notably, as is clear, both the bypass line 204 and the discharge valve 200 are downstream of the compressor pump unit 23 defined by the scroll members 22 and 24.

When the control moves the suction valve 210 to a closed position, the discharge valve 200 is also closed and the bypass valve 216 is opened. In this manner, the refrigerant is returned from the discharge chamber 123 to the suction chamber 121. At the same time, the closed discharge valve 200 blocks the backflow of refrigerant from the discharge line 206 into the discharge chamber 123. Therefore, the pressure in the discharge chamber 123 can now be maintained at the same or nearly the same low pressure as the pressure in the suction chamber 121. This reduces power consumption of the compressor motor 28, because the refrigerant no longer needs to be compressed to the pressure, corresponding to the high pressure in the condenser 36. The discharge valve 200 typically needs to be open within the time interval of 0 to 0.2 seconds of (before or after) the closing of the pulse width modulation valve 210. The discharge valve 200, if it is a solenoid type valve, can be typically closed within the range of 0 to 0.2 seconds of the closing of the valve 210. If the discharge valve 200 were, for example, a mechanical check valve, it would shut close automatically, as the refrigerant from the condenser 36 would begin to move into chamber 123 closing the discharge valve 200.

Figure 2:
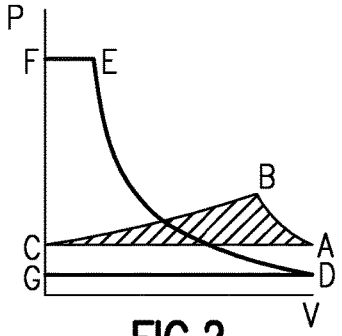
FIG. 2 shows a pressure versus volume graph for the compressor.

FIG. 2 shows a so-called PV diagram that represents compression process in the compressor 21. In this diagram, P is changing pressure within the scroll elements and V is changing compression volume within the scroll elements for the compressor 21. The area covered by the PV diagram is indicative of the power consumed by the compressor 21. As shown in FIG. 2, the cross-hatched area (ABC) is indicative of the power consumed by the compressor 21 incorporating the invention when the pulse width modulation valve 210 is in the closed position and the inventive bypass arrangement is present. The non-cross hatched area (DEFG) is indicative of the power consumed by the compressor 21 without the inventive bypass line when the pulse width modulation valve 210 is closed. As can be appreciated, the present invention can save substantial amount of energy, as shown by comparison of the above two areas in FIG. 2. It should be understood that this graph is an illustration, and actual results will vary for any given compressor and operating conditions. As also shown in FIG. 2, the point G indicates pressure within the compressor suction cavity 121 without the inventive bypass arrangement when the suction modulation valve 210 is in the closed position. As known, this pressure needs to be maintained above a certain threshold for compressors with hermetically sealed motors (if this pressure decreases below a certain value, the motor terminal pins can be damaged by a so-called "corona discharge" effect, which occurs at near vacuum conditions in the compressor suction cavity 121). Normally, this pressure is kept at about 1 psia level. Without the bypass arrangement, the pressure in the discharge chamber 123 will be at the discharge pressure indicated by point F.

When the bypass arrangement is employed, the pressure will be relieved to the pressure approaching the suction pressure, as indicated by the point C. Since in the inventive arrangement, the discharge pressure is reduced from F to C, the motor would consume less power, due to reduced amount of work required to compress the refrigerant. Also, it has to be noted that, for this inventive bypass arrangement, the suction pressure would increase somewhat from the pressure indicated by the point G to the pressure indicated by the point C. This occurs as some of the refrigerant trapped on the discharge side is re-expanded back into the suction chamber 121, causing the pressure in the suction chamber 121 to rise above the pressure indicated by the point G, which was the pressure level in the prior art pulse width modulation arrangement.

It should be understood that although this invention is described in relation to refrigerant systems incorporating scroll compressors, it is applicable to various compressor types, including screw compressors, reciprocating compressors, rotary compressors, etc. It is can also be applied to different refrigerant systems, including residential air conditioning applications, container and truck-trailer applications, heat pump application, supermarket applications, rooftop applications, etc. The refrigerant systems can also include additional features, such as economized circuit, employing a compressor having a vapor injection line. The compressor can also have bypass line, which bypasses refrigerant from an intermediate compression point to suction. If the intermediate to suction line bypass line is employed, then the connection between the discharge bypass, described in this application, and compressor suction can also be established via the intermediate to suction bypass line. Of course this invention would apply to various types of refrigerants, such, for example, R410A, R134a, R22, R407C, R744, etc.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerant system comprising:

a compressor having a compressor pump unit for compressing refrigerant to a discharge pressure and an electric motor for driving said compressor, said compressor housed within a housing shell;

a condenser positioned downstream of said compressor, an expansion device positioned downstream of said condenser, and an evaporator positioned downstream of said expansion device;

a suction valve positioned on a suction line leading from said evaporator into said compressor housing shell;

a control for using pulse width modulation for cycling said suction valve between an open position and a closed position, said suction valve blocking the flow of a refrigerant through the suction line when in the closed position; and a bypass line for selectively bypassing refrigerant at a point downstream of said compressor pump unit and compressed to a discharge pressure by said compressor pump unit, and to a location downstream of said suction valve, and leading to a suction line leading into a housing shell and said bypass line including a bypass valve, said bypass valve being controlled by said control, said bypass valve being opened when said suction valve is closed by said control.

2. The refrigerant system as set forth in claim 1, wherein said compressor is selected from the group consisting of a scroll compressor, a rotary compressor, a reciprocating compressor, and a screw compressor.

3. The refrigerant system as set forth in claim 1, wherein a discharge valve is also positioned on the discharge side of the compressor and downstream of said bypass line.

4. The refrigerant system as set forth in claim 3, wherein said discharge valve is closed when said suction valve is controlled to be closed and said bypass valve is controlled to be opened.

5. The refrigerant system as described in claim 4, wherein said discharge valve is closed in the time interval between 0 and 0.2 seconds of the closure of said suction valve.

6. The refrigerant system as described in claim 4, wherein said bypass valve is opened in the time interval between 0 and 0.2 seconds of the closure of said suction valve.

7. The refrigerant system as set forth in claim 1, wherein said bypass valve is opened in the time interval between 0 and 0.2 seconds of the closure of said suction valve.

8. A method of operating a refrigerant system comprising the steps of:

(1) providing a compressor having a compressor pump unit for compressing refrigerant to a discharge pressure and an electric motor for driving said compressor, said compressor housed within a housing shell;

(2) providing a condenser positioned downstream of said compressor, an expansion device positioned downstream of said condenser, and an evaporator positioned downstream of said expansion device;

(3) providing a suction valve positioned on a suction line leading from said evaporator into said compressor housing shell;

(4) using pulse width modulation for cycling said suction valve between an open position and a closed position, said suction valve blocking the flow of a refrigerant through the suction line when in the closed position; and (5) selectively bypassing refrigerant compressed by said compressor pump unit to a discharge pressure and downstream of said compressor pump unit to a location that continues downstream of said suction valve and leading to a suction line leading into said housing shell, and a bypass line including a bypass valve, said bypass valve being controlled by said control, said bypass valve being opened when said suction valve is closed by said control.

9. The method as set forth in claim 8, wherein a discharge valve is also positioned on the discharge side of the compressor and downstream of said bypass line.

10. The method as set forth in claim 8, wherein said discharge valve is closed when said suction valve is controlled to be closed and said bypass valve is controlled to be opened.

11. The method as described in claim 10, wherein said discharge valve is closed in the time interval between 0 and 0.2 seconds of the closure of said suction valve.

12. The method as described in claim 10, wherein said bypass valve is opened in the time interval between 0 and 0.2 seconds of the closure of said suction valve.

13. The method as set forth in claim 8, wherein said bypass valve is opened in the time interval between 0 and 0.2 seconds of the closure of said suction valve.

* * * * *